US012195882B2

(12) United States Patent
Chin et al.

(10) Patent No.: US 12,195,882 B2
(45) Date of Patent: Jan. 14, 2025

(54) HOT MELT FIBERS FOR ANTIMICROBIALS AND THEIR PREPARATION METHODS

(71) Applicant: SILVER PARTICLE COMPANY LIMITED, Kl (HK)

(72) Inventors: Yuen Keung Raymond Chin, Brisbane (AU); O Lun Leung, N.T. (HK)

(73) Assignee: SILVER PARTICLE COMPANY LIMITED, Kl (HK)

( * ) Notice: Subject to any disclaimer, the term of this patent is extended or adjusted under 35 U.S.C. 154(b) by 546 days.

(21) Appl. No.: 17/385,037

(22) Filed: Jul. 26, 2021

(65) Prior Publication Data

US 2021/0395922 A1 Dec. 23, 2021

Related U.S. Application Data

(63) Continuation of application No. PCT/CN2020/073355, filed on Jan. 21, 2020.

(30) Foreign Application Priority Data

Feb. 1, 2019 (CN) ..... 201910104987.4

(51) Int. Cl.

| | |
|---|---|
| ***D01F 1/10*** | (2006.01) |
| ***D01D 5/08*** | (2006.01) |
| ***D02G 3/04*** | (2006.01) |
| ***D03D 15/587*** | (2021.01) |

(52) U.S. Cl.

CPC ..... *D01F 1/103* (2013.01); *D01D 5/08* (2013.01); *D02G 3/04* (2013.01); *D03D 15/587* (2021.01); *D10B 2401/041* (2013.01); *D10B 2401/13* (2013.01)

(58) Field of Classification Search

None

See application file for complete search history.

(56) References Cited

U.S. PATENT DOCUMENTS

2017/0290329 A1* 10/2017 Ahmad ..... C08K 3/08

OTHER PUBLICATIONS https://patents.google.com/patent/US20170290329A1/en?oq=CN+109072485+A+ (Year: 2017).*

* cited by examiner

*Primary Examiner* — Arti Singh-Pandey

(57) ABSTRACT

This application relates to a hot-melt fiber containing silver particles, a preparation method thereof, and an article containing the hot-melt fiber.

9 Claims, 2 Drawing Sheets

HOT MELT FIBERS FOR ANTIMICROBIALS AND THEIR PREPARATION METHODS

CROSS-REFERENCE OF RELATED APPLICATIONS

This application claims the priority and rights of patent application No. 201910104987.4 filed with the State Intellectual Property Office of China on Feb. 1, 2019, and the entire content of the application is incorporated herein by reference.

TECHNOLOGY

This application relates to the field of antimicrobial, in particular, to hot-melt fibers with antimicrobial effects, products containing the hot-melt fibers, methods for preparing the hot-melt fibers, and uses of the hot-melt fibers.

TECHNICAL BACKGROUND

In recent decades, nano-silver has become the most commonly used material in sterilization products. However, more and more studies have shown that the widespread use of nano-silver may cause serious harm to human health and the environment. A recent study reviewed the current global research on the toxicity of nanoparticles and pointed out that silver nanoparticles may be harmful to the environment. In addition, when nano-silver is used in products that are in direct contact with the human body, the nano-silver will penetrate into the human skin and cause direct harm to the human body.

In this regard, the art has used micron-sized silver wires or silver compounds to try to solve the harm caused by the penetration of nano-silver into the skin. However, the silver wire will be deformed after washing the product many times, and the silver compound will still ooze out of the product, thus causing harm to human health and the environment.

As such, this application provides a hot melt fiber with antimicrobial effect and a preparation method thereof, thereby solving one or more technical problems in the art.

INVENTION CONTENT

In one aspect of the present application, there is a thermally fusible fiber provided, which includes a plurality of thermal fuses and an effective amount of antimicrobial effective amount of silver particles with a particle size of 2000 mesh to 8000 mesh, wherein the silver particles are a single substance of silver and are physically The doped form is contained in the thermal fuse, and wherein the thermal fuse is substantially free of silver particles or silver ions released during the process of inhibiting or killing microorganisms, and the thermal fuse undergoes washing with water. After this time, the content of the silver particles is basically unchanged. On the other hand of this application, an antimicrobial product is provided, woven separately from or in conjunction with other textile fibers.

In another aspect of the present application, a product with antimicrobial efficacy is provided, which is woven from the above-mentioned hot melt fiber alone or woven together with other textile fibers.

On the other hand, in this application, the use of hot melt fibers in antimicrobial products described above is provided.

ILLUSTRATED INSTRUCTIONS

OVERALL IMPLEMENTATION

Figure 1:
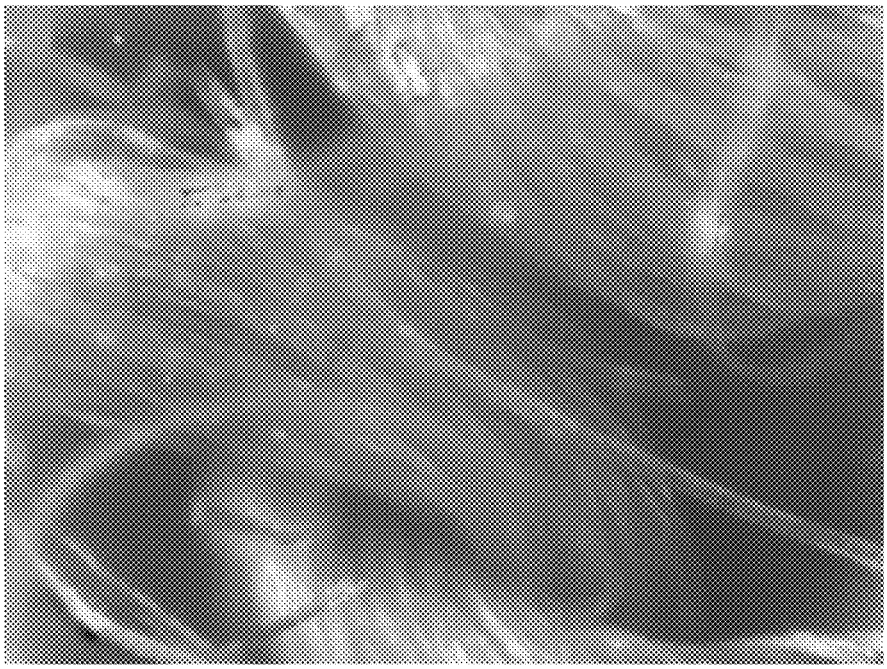
FIG. 1 is an 800-fold microscopic photo of the fabric obtained from the braiding of hot-melt fibers and cotton threads under one of the implementations of this application, in which the ratio of the number of hot-melt fiber roots to the number of cotton thread roots is 4:6.
Figure 2:
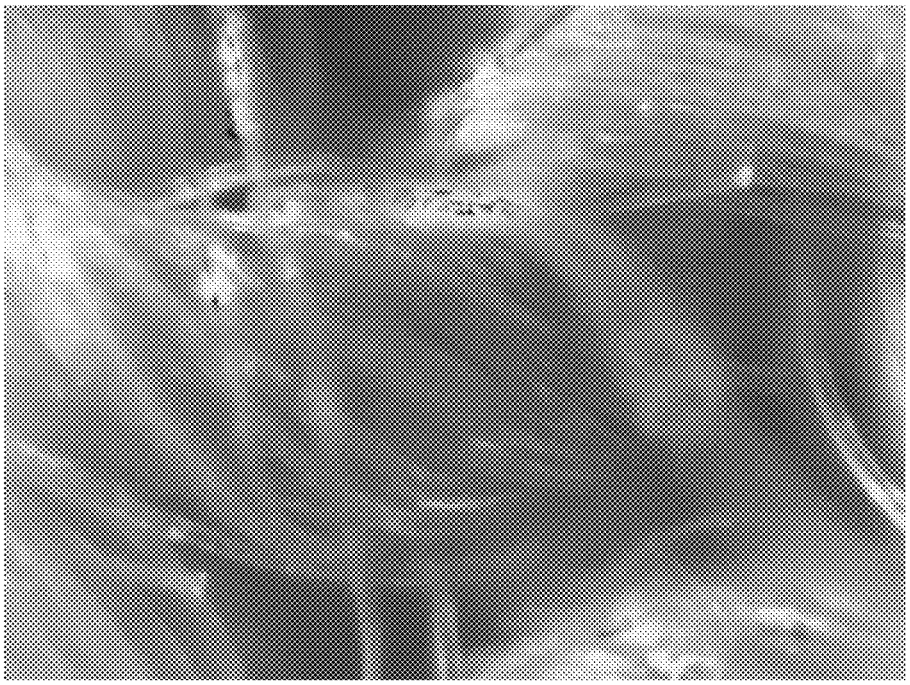
FIG. 2 is an 800-fold microscopic photo of the fabric obtained from the braiding of hot-melt fibers and yarns under another implementation of this application, in which the ratio of the number of hot-melt fiber roots to the number of yarn roots is 4:6.
Figure 3:
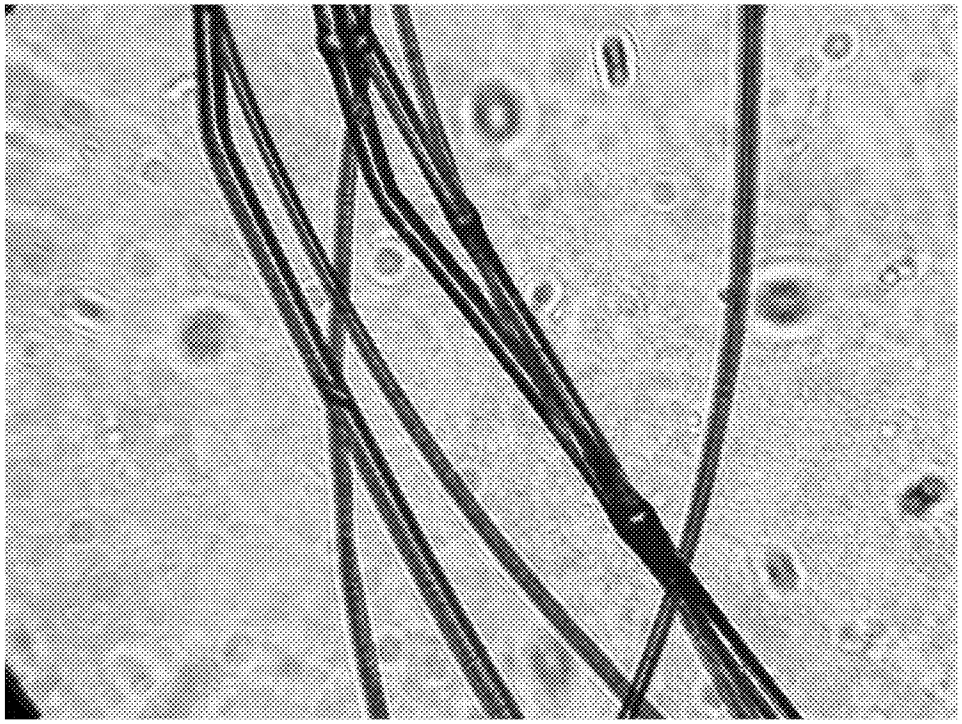
FIG. 3 is a 1000× microphotography of hot fuses based on one of the implementations of this application.

The following description includes certain specific details for a thorough understanding of various disclosed implementations. However, those skilled in the relevant art should understand that one or more of these specific details may not be required, or other methods, ingredients, materials, etc. may be used to practice the implementations.

Unless the context requires otherwise, in the following specification and claims, the terms "including" and "inclusive" shall be interpreted as open-ended and inclusive meanings, that is, they shall be interpreted as "including (inclusive), but not limited to".

The term "one implementation plan", or "implementation plan", or "another implementation plan", or "certain implementation plan" referred to in the entire specification, means that the specific characteristics, structures or characteristics associated with the implementation plan are included in at least one implementation plan. Therefore, the phrases "one implementation plan," "implementation plan," "another implementation plan," or "some implementation plan" that appear throughout the specification do not have to refer to the same implementation. In addition, specific characteristics, structures, or characteristics can be combined in any appropriate way in one or more implementations.

It should be noted that the amounts of all expressions used in the instructions and claims, indicating the value of the reaction conditions, should be understood to be modified by the term "about". Therefore, unless otherwise indicated, the numerical parameters given in this manual and the attached claim are approximate and may vary according to the required nature sought in this application. There is no intention to limit the application of the principle of equiqual to the scope of claims, and each numerical parameter should be understood according to valid numbers and commonly used rounding methods.

Definitions

Unless expressed to the contrary, the following terms used in the instructions and attached claims have the following meanings:

The term "antimicrobial" or "antimicrobial" used herein refers to the general term for the role of inhibiting or killing microorganisms (e.g. bacteria, fungi, etc.), the term "inhibiting microorganisms" refers to the role of inhibiting the growth and reproduction of microorganisms, and the term "killing microorganisms" refers to the role of killing microbial nutrients and reproductions. In this paper, microorganisms mainly refer to bacteria, fungi and so on.

The term "antimicrobial effectiveness" used in this article refers to the amount of antimicrobial action that can be achieved as expected. In general, the antimicrobial effects that need to be achieved may vary depending on the antimicrobial requirements. For example, in some parts of this application, the antimicrobial effective amount of silver particles may refer to silver particles based on fiber substrate meters, approximately 0.1-10 weight %. In other parts, the effective amount of antimicrobial silver particles may refer to silver particles based on fiber substrate meters, about 0.5-8% by weight. In other parts, the antimicrobial effective amount of silver particles may refer to silver particles based on fiber substrate meters, about 1-5% of the weight.

The term "silver particles" as used herein refers to silver micron-sized particles that are round or quasi-circular (such as elliptical or irregular round). Based on this, silver wires (or silver wires), silver flakes (or silver foils), silver rods, etc. are not included in the scope of "silver particles" as used herein. In addition, the "silver particles" used herein mainly refers to elemental silver particles, and does not contain silver ions or silver compounds. Of course, in the actual production and application process, the silver particles may also contain an indispensable amount of non-silver impurities (for example, less than 1% by weight), which can be understood and recognized by those skilled in the art.

The term "basically" used in this article refers to the amount of change in the specified value less than ±5% of the specified value, the preferred ±3%, and the preferred ±1%. For example, "the content of silver particles is basically the same" means that the amount of silver particles changes less than ±5% of the content of silver particles, preferably ±3%, and preferably ±1%. "Basically no silver particles or silver ions released" means that the weight of the released silver particles or silver ions is less than ±3% of the weight of the original silver particles, preferably ±1%, preferred ±0.5%, and preferably ±0.1%. Similarly, this should be explained when the term "basically" modifies other values.

Theory Behind No Antibacterial Mechanism Released by Silver Particles or Silver Ions In this application, the metal silver particles are hidden in the matrix (plastic material), and the silver ion cluster electric field is used to inhibit or kill microorganisms, and in the process of inhibiting or killing microorganisms, there are basically no silver ions or silver particles. Released from the matrix, thereby avoiding harm to the human body or polluting the environment.

The Detection Method of Trace Silver or Silver Ions

According to the US Environmental Protection Agency (EPA) method for determining trace elements in water and waste by inductively coupled plasma-mass spectrometry (EPA 200.8: 1994, ICP-MS), it is tested whether the antimicrobial fiber in this application releases silver or silver ions.

Antimicrobial Performance Test Methods and Anti-Microbial Effects Antimicrobial Effects The antimicrobial effect of antimicrobial products is obtained by the value of antimicrobial properties, and the detection method is FZ/T 73023-2006. In the present application, the hot-melt fiber or the fabric composed of it can still meet FZ/FZ/F after undergoing 50 washings, preferably 100 washings, more preferably 150 washings, and most preferably 300 washings. The value specified in T 73023-2006.

Antimicrobial Performance Test Method

1. Test Bacteria

*Staphylococcus aureus* (ATCC 6538); *Escherichia coli* (ATCC 25922); *Candida albicans* (ATCC 10231)

The above test bacteria are designated and provided by the National Knitting Product Quality Supervision and Testing Center 2. Testing Standards

FZ/T 73023-2006

Implementation Sample

In the first aspect of this application, a hot melt fiber containing multiple hot fuses and antimicrobial effective amounts of silver particles with a particle size of 2000 mesh to 8000 mesh objectives is provided, wherein the silver particles are silver monomorphic and are included in the hot fuse in the form of physical doping. The hot melt fiber in the process of inhibiting or killing microorganisms is basically no silver particles or silver ion release, and the hot melt fiber after 50 washes, the content of the silver particles is basically unchanged.

In one implementation, the particle size of the silver particles is 2000 mesh to 8000 mesh and any values in the range of 2000 mesh to 8000 mesh, for example, 2500, 3000, 3500, 4000, 4500, 5000, 5500, 6000, 6500, 7000, or 7500, and any range of these values. In one preferred implementation, the particle size of silver particles is 3000 mesh to 5000 mesh. In further preferred implementations, silver particles have particle sizes from 3500 to 4500.

Here, when the particle size of the silver particles is larger than the above range, the cost of the hot-melt fiber will be too high and affect the shape of the final hot-melt fiber, so that the price and application of the final product are not competitive, for example, too large the silver particles will protrude too much from the thermal fuse of the usual size, which may fall off during the washing process and affect the texture of the fiber product. When the particle size of the silver particles is smaller than the above range, the electric field generated by the silver particles may be insufficient, so that due to the cover (for example, wrapped by a thermal fuse), microorganisms cannot be effectively killed or inhibited. The applicant found through a lot of experiments that when the particle size of the silver particles is within the above range, even when wrapped by a covering material (such as a thermal fuse) of 35 μm or more, or even 50 μm or more, it can effectively inhibit or kill (The killing rate is higher than 99%) The microbes on or around the cover, and the corresponding thermal fuse diameter does not need to be too large, thereby ensuring the normal texture of the fabric.

In one implementation, the thermally fusible fibers include 50 to 190 thermal fuses, and silver particles are contained in the thermal fuses. In another implementation, the thermal fusible fiber contains 80 to 140 thermal fuses, and the silver particles are contained in the thermal fuses. In view of the actual industrial production situation, the silver particles need not be completely contained in the hot-melt fiber, and a small part of a few silver particles (i.e. less than 40% of the total volume of the particles) may protrude from the surface of the hot-melt fiber. Additionally, it is also possible to twist fewer or more thermal fusible filaments into thermal fusible fibers according to actual needs, which can be completely determined by those skilled in the art. In a preferred implementation, the silver particles are completely contained in the thermal fuse, that is, when the thermal fuse is viewed from the outside, the silver particles cannot be directly observed.

In one implementation, the content of silver particles remained essentially the same after 50 washes of hot melt fibers, such as changes in silver particles of less than 0.1%, 0.05%, 0.01%, or less. In another implementation, the content of silver particles remained essentially the same after 100 washes of hot melt fibers, such as changes in the content of silver particles of less than 1%, 0.5%, 0.1%, 0.05%, or less. In another implementation, after 150 washes of hot melt fibers, the content of silver particles remained essentially the same, for example, the content of silver particles changed by less than 2%, 1%, 0.5%, 0.1%, or less. In further implementations, the content of silver particles remained essentially the same after 300 washes of hot melt fibers, such as changes in silver particles of less than 3%, 2%, 1%, or lower.

In this article, the water washing mentioned is completed by the following operations: weave the hot-melt fiber described in this article into a fabric and placed in the washing machine, (using the agitating washing machine—B Type Washing Machine as referenced in GB/T 8629-2001), using the 7B program of the washing machine, and set the washing time to 5 minutes. Adding 2 g/L detergent (using the AATCC 1993 standard detergent WOB phosphorus-free detergent as specified in GB/T 8629-2001 Appendix A) and tap water, with bath ratio of 1:30, water temperature 40±3° C., wash for 5 minutes; wash the fabric with tap water for 2 minutes. The fabric is then taken out and dehydrated for 30 seconds; use tap water to clean the fabric again for 2 minutes, then taken out and spin to drain for 30 seconds, thus completing a washing cycle. Based on this step, a spectrometer is used to measure the content of silver particles in the fiber before washing and after a specific number of washings.

Generally, silver particles with large particle sizes can cause the cost of the final product to be too high, and it is not easy to release silver particles or silver ions from the product to kill microorganisms. However, based on the principle of non-contact to kill microorganisms in this application, silver particles can inhibit or kill microorganisms without contact with microorganisms, thus avoiding harm to human body or environmental pollution. In addition, since the hot-melt fibers in this application can undergo more than 300 washes and the efficacy of killing microorganisms remains virtually unchanged, they can be reused multiple times, indirectly reducing the cost of using the final product. Furthermore, it was found that when using the hot melt fibers defined herein, even when mixed with a high proportion of other woven fibers, the antimicrobial properties of the resulting fabrics were still much higher than the relevant standards In one implementation, the thermal fuse may be based on the following monofilaments: polyester, nylon, spandex, polyurethane, Rayon, Viscose, polypropylene, polystyrene, polyvinyl chloride, polymethyl methacrylate, polycarbonate. However, the implementations of this application are not limited thereto, and other thermal fuses commonly used in the field can also be used in this application. In another implementation, the diameter of the thermal fuse is 3 μm to 16 μm, preferably 5 μm to 15 μm. In yet another implementation, the weight ratio of silver particles to hot melt fibers is 1:400 to 1:1000; preferably, 1:500 to 1:800. The thermal fuse with the above diameter and the silver particles with the above weight ratio can make the thermal fuse have normal mechanical properties and can exert the effective antimicrobial effect of silver particles. Even after weaving with other fibers, the resulting fabric can also have Antimicrobial effect of silver particles. In one implementation, the spacing between silver particles in a single hot fuse is 50 μm to 150 μm, preferably 70 μm to 120 μm. In another implementation, multiple thermal fuses form thermal fusible fibers in a crimped manner, with the silver particles contained in each thermal fuse arranged at substantially equal intervals. In this implementation, the hot melt fiber has a crimped configuration, and the number of crimped troughs or crests is 8-15/25 mm.

In another aspect of this application, a product with antimicrobial efficacy is provided, which is woven from the hot-melt fiber described herein, or is woven from the hot-melt fiber described herein and other textile fibers. In one implementation, the product is woven from hot-melt fibers and other textile fibers, wherein the fineness of the hot-melt fibers is the same as or different from that of other textile fibers. In another implementation, the product is woven from hot-melt fibers and other textile fibers, wherein the fineness of the hot-melt fibers is the same as that of other textile fibers, and the number of hot-melt fibers is the same as that of other textile fibers. The ratio is 20-80:80-20, for example, 20:80, 30:70, 40:60, 50:50 or 60:40. As mentioned above, it is found that even if the hot-melt fiber and other textile fibers are woven into a product with a 20:80 root ratio, the resulting fabric product can still meet the relevant national standards (for example, FZ/T 73023-2006). For cost and practical application considerations, the ratio of the number of hot melt fibers to the number of other textile fibers is 20-40:80-60.

In this paper, the weaving process includes machine weaving, puncture, knitting and so on. The hot melt fiber dimension of this application may consist of a single hot fuse, or it may also consist of a number of different hot fuses. In one implementation, the application of hot melt fiber can be used for clothing, bedding, cleaning supplies, protective supplies, medical supplies, nursing supplies, for example, the application of hot melt fiber can be used for gloves, masks, underwear, underwear, baby robes, sweatshirts, burqas, T-shirts, spacesuits, socks, insoles, hats, bras, abs, swimsuits, towels, bed linen, bandages, but not limited to this.

In another aspect of the present application, a method for preparing the hot melt fiber described herein is provided, which includes: mixing and extruding silver particles with plastic raw materials to obtain a liquid melt; spinning and drawing the liquid melt to obtain A thermal fuse containing silver particles; a plurality of the thermal fuse wires are twisted and shaped to obtain the thermal fuse fiber.

In one implementation, the particle size of the silver particles is 2000 mesh to 8000 mesh and any values in the range of 2000 mesh to 8000 mesh, for example, 2500, 3000, 3500, 4000, 4500, 5000, 5500, 6000, 6500, 7000, or 7500, and any range of these values. In one preferred implementation, the particle size of silver particles is 3000 to 5000. In further preferred implementations, silver particles have particle sizes from 3500 to 4500.

In one implementation, the mixing ratio of silver particles to plastic raw materials is 1:400 to 1:1000; In another implementation, the wired hot fuse has a diameter of 3 μm to 16 μm, preferably 5 μm to 15 μm. In one implementation, hot melt fibers are combined from 50 to 190 hot fuses, and silver particles are contained in hot fuses. In another implementation, hot melt fibers are combined from 80 to 140 hot fuses, and silver particles are contained in hot fuses.

In one implementation, the silver particles are silver monosystic particles. In another implementation, the plastic raw materials are selected from polyester, nylon, spandex, polyurethane, Rayon raw materials, Viscose raw materials, polypropylene, polystyrene, polyvinyl chloride, polymethyl acrylates, polycarbonate.

In one implementation, the extrusion step is carried out at 270-310° C., preferably in a twin screw extruder. In another implementation, the spinning step is performed at 270-290° C., for example, in a spinning winder. In one implementation, the thermal fuse may be subjected to a drawing process to achieve a prescribed linear density, for example, a multi-pass drawing process, such as a 3-pass drawing, and the thermal fuse may be drawn to a length of 3-4 times. In another implementation, the traction setting temperature of the thermal fuse is 130-190° C.

In one implementation, the hot-melt fiber obtained by twisting may undergo a drawing process to obtain the desired denier. In another implementation, the hot-melt fiber may undergo a crimping process to increase cohesion, such as in a preheated crimping machine. Preferably, the number of crimped troughs or crests of the hot melt fiber is 8-15/25 mm. In yet another implementation, the crimped hot melt fiber may undergo a relaxation setting process, wherein the setting temperature is 70-120° C.

Specific implementations of the disclosure of the present application will be explained in detail through the examples listed below, so as to better understand the various aspects and advantages of the present application. However, it should be understood that the following examples are non-limiting and are only used to illustrate certain implementations of the present application.

IMPLEMENTATION EXAMPLES

Example 1

Place 20 kg of polyester raw material into a drying drum and dry at 140° C. so that the moisture content of the polyester raw material is less than 100 ppm. The silver particles with a particle size of 4000 mesh and the dried polyester raw material were fed into a screw extruder through a quantitative hopper according to a weight ratio of 1:600, and the liquid melt was extruded at 270° C. The liquid melt is directly supplied to the spinneret, spun at 270-290° C. and wound and drawn to obtain a thermal fuse containing silver particles. Each 140 thermal fusible filaments are twisted into thermal fusible fibers, dried and relaxed at 80° C., and then cut into 102 mm lengths to obtain the final thermal fusible fibers. The obtained hot-melt fiber and the commercially available polyester fiber without silver particles were woven into a 0.5 m×0.5 m plain weave (marked as sample 1) at a number ratio of 40:60.

Example 2

Place 20 kg of polyester raw material into a drying drum and dry at 140° C. so that the moisture content of the polyester raw material is less than 100 ppm. The silver particles with a particle size of 5000 mesh and the dried polyester raw material were added into a screw extruder through a quantitative hopper according to a weight ratio of 1:1000, and the liquid melt was extruded at 290° C. The liquid melt is directly supplied to the spinneret, spun at 270-290° C. and wound and drawn to obtain a thermal fuse containing silver particles. Each 190 thermal fusible filaments are twisted into thermal fusible fibers, dried and relaxed at 90° C., and then cut into 102 mm lengths to obtain the final thermal fusible fibers. The obtained hot-melt fiber and the commercially available polyester fiber without silver particles were woven into a 0.5 m×0.5 m plain weave (marked as sample 2) at a number ratio of 40:60.

Example 3

Place 20 kg of polyester raw material into a drying drum and dry at 140° C. so that the moisture content of the polyester raw material is less than 100 ppm. The silver particles with a particle size of 3000 mesh and the dried polyester raw material were fed into a screw extruder through a quantitative hopper according to a weight ratio of 1:500, and the liquid melt was extruded at 290° C. The liquid melt is directly supplied to the spinneret, spun at 270-290° C. and wound and drawn to obtain a thermal fuse containing silver particles. Each 160 thermal fusible filaments are twisted into thermal fusible fibers, dried and relaxed at 90° C., and then cut into 102 mm lengths to obtain the final thermal fusible fibers. The obtained hot-melt fiber and the commercially available polyester fiber without silver particles were woven into a 0.5 m×0.5 m plain weave (marked as sample 3) at a number ratio of 40:60.

Example 4

Place 20 kg of polyester raw material into a drying drum and dry at 140° C. so that the moisture content of the polyester raw material is less than 100 ppm. The silver particles with a particle size of 4000 mesh and the dried polyester raw material were fed into a screw extruder through a quantitative hopper according to a weight ratio of 1:600, and the liquid melt was extruded at 270° C. The liquid melt is directly supplied to the spinneret, spun at 270-290° C. and wound and drawn to obtain a thermal fuse containing silver particles. Each 140 thermal fusible filaments are twisted into thermal fusible fibers, dried and relaxed at 80° C., and then cut into 102 mm lengths to obtain the final thermal fusible fibers. The obtained hot-melt fiber and the commercially available polyester fiber without silver particles were woven into a 0.5 m×0.5 m plain weave (marked as sample 4) at a number ratio of 20:80.

Example 5—Detection of Silver or Silver Ion Release

The plain weave fabric prepared in Example 1 was washed 50 times, 100 times, 150 times, and 300 times as specified in this article, and the washed plain weave cloth was placed in purified water (40±3° C.) at 40° C. Soak for 4 hours at temperature, use EPA 200.8: 1994, ICP-MS to test the silver content in the water, the results are shown below.

| Test | Method | Results | Detection limit |
|---|---|---|---|
| 50 washes | EPA 200.8: 1994, ICP-MS | Not Detected | 2 μg/L |
| 100 washes | EPA 200.8: 1994, ICP-MS | Not Detected | 2 μg/L |
| 150 washes | EPA 200.8: 1994, ICP-MS | Not Detected | 2 μg/L |
| 300 washes | EPA 200.8: 1994, ICP-MS | Not Detected | 2 μg/L |

Example 6—Non-Contact Antimicrobial Efficacy of Silver Particles

Disperse silver particles with a particle size of 5000 mesh on the glass bottom plate, and place the top layer of cowhide with a thickness of 1.5 mm against the surface of the glass bottom plate where the silver particles are dispersed, and then use a polyethylene cling film with a thickness of 35 μm to cover the glass bottom plate. Wrap tightly with the first layer of cowhide to get the initial sample. Manually vibrate the test sample to make a part of the silver particles penetrate into the pores of the cowhide to obtain the test sample. A control sample was constructed in a similar manner, but without adding any silver particles.

*Staphylococcus aureus* (ATCC 6538P) was used to test the antibacterial properties of the sample according to the JIS Z 2801:2010 test method, in which the bacterial liquid was coated on the fresh-keeping film covering the upper surface of the cowhide. The experimental results are shown in the table below:

| Experimental Strain | Inoculum Concentration (units/mL) | Inoculum Volume (mL) | The average of the number of bacteria obtained after different exposure times (/cm²) / | 0 hours | 24 hours | Antibacterial Active Substance |
|---|---|---|---|---|---|---|
| Staphylococcus aureus ATCC 6538P | $1.4 \times 10^6$ | 0.2 | Sample | / | 0.57 | 2.5 |
| | | | Contrast Sample | 4.22 | 3.04 | |

It can be seen that even with 35 μm thick polyethylene cling film (silver particles do not penetrate into the polyethylene cling film, only the cowhide), the silver particles can also exert an effective antibacterial effect in a non-contact manner (antibacterial Rate>99.9%). This also provides further experimental support for this application.

Example 7—Sterilization Performance Testing

Using the antibacterial performance test method described in this application (i.e. FZ/T 73023-2006), the samples obtained in Examples 1 to 4 were washed 50 times with water, and the sterilization effect of the washed samples was tested. The results are shown in the following table.

| Sample | Test Item | Unit | Standard Value | Measured Value |
|---|---|---|---|---|
| Sample 1 | *Staphylococcus Aureus* Inhibition Rate | % | ≥80 | 97.5 |
| | *Escherichia Coli* Inhibition Rate | % | ≥70 | 90.7 |
| | Candida Albicans Inhibition Rate | % | ≥60 | 86.1 |
| Sample 2 | *Staphylococcus Aureus* Inhibition Rate | % | ≥80 | 96.7 |
| | *Escherichia Coli* Inhibition Rate | % | ≥70 | 90.9 |
| | Candida Albicans Inhibition Rate | % | ≥60 | 87.4 |
| Sample 3 | *Staphylococcus Aureus* Inhibition Rate | % | ≥80 | 98.0 |
| | *Escherichia Coli* Inhibition Rate | % | ≥70 | 90.1 |
| | Candida Albicans Inhibition Rate | % | ≥60 | 87.6 |
| Sample 4 | *Staphylococcus Aureus* Inhibition Rate | % | ≥80 | 89.3 |
| | *Escherichia Coli* Inhibition Rate | % | ≥70 | 72.0 |
| | Candida Albicans Inhibition Rate | % | ≥60 | 66.4 |

It can be seen from the above that the hot-melt fiber of the present application can maintain effective antimicrobial performance even after being washed for many times, and after repeated use for many times, almost no silver particles are released from the fiber. In addition, even after the hot-melt fiber of the present application is mixed with other fibers and woven into a fabric product, the resulting product can still maintain effective antibacterial effect, and even if other fibers account for 80%, the antibacterial effect of the product is still significantly higher than the relevant national standards.

It can be understood from the foregoing that, although specific implementations of the present application are described for illustrative purposes, those skilled in the art can make various modifications or improvements without departing from the spirit and scope of the present application. These deformations or modifications should fall within the scope of the appended claims of this application.

What is claimed is:

1. A thermally fusible fiber, which comprises a plurality of thermal fuses and an antimicrobial effective amount of silver particles with a particle size of 2000 mesh to 8000 mesh, wherein the silver particles are simple silver and are contained in the thermal fuse in a physically doped form;

a silver ion cluster electric field generated by the silver particles is used to inhibit or kill microorganisms and in the process of inhibiting or killing microorganisms, the hot-melt fiber basically has no silver particles or silver ions released, and after the hot-melt fiber has been washed with water for 50 times, the content of the silver particles is basically constant;

wherein the silver particles are a silver micron-sized particles that are round or quasi-circular and completely contained in the thermal fuses.

2. The thermal fuse fiber according to claim 1, wherein the particle size of the silver particles is 3000 mesh to 5000 mesh, more preferably 3500 mesh to 4500 mesh; and wherein the diameter of the thermal fuse wire is 3 μm to 16 μm, preferably 5 μm to 15 μm.

3. The hot-melt fiber according to claim 1, wherein after the hot-melt fiber is washed with water 100 times, the content of the silver particles is substantially unchanged; preferably, after the hot-melt fiber is washed with water 150 times, The content of the silver particles is substantially unchanged; more preferably, the content of the silver particles is substantially unchanged after the hot-melt fiber undergoes washing 300 times.

4. The hot-melt fiber of claim 1, wherein the hot-melt fiber is based on the following monofilaments: polyester, nylon, polyurethane, Rayon, polypropylene, polystyrene, polyvinyl chloride, poly Methyl acrylate, polycarbonate.

5. The thermally fusible fiber of claim 1, wherein the weight ratio of the silver particles to the thermal fuse is 1:400 to 1:1000; preferably, 1:500 to 1:800; and wherein the thermal The fusible fiber includes 50 to 190 of the thermal fuse, preferably 80 to 140 of the thermal fuse.

6. The thermally fusible fiber according to claim 1, wherein in a single thermal fuse, the spacing between silver particles is 50 μm to 150 μm, preferably 70 μm to 120 μm; and wherein the thermally fusible fiber is crimped Configuration, and the number of crimped troughs or crests is 8-15/25 mm.

7. A product with antimicrobial effect, which is woven by the hot-melt fiber described in claim 1, or woven together with other textile fibers.

8. The products referred to in claim 7 are clothing, bedding, cleaning supplies, protective supplies, medical supplies, nursing supplies such as gloves, masks, underwear, panties, baby monk robes, sweatshirts, burqas, T-shirts, spacesuits, socks, insoles, hats, bras, belly belts, swimsuits, towels, sheets, covers, bandages.

9. The use of the hot-melt fiber according to claim 1 in the preparation of antimicrobial products.

* * * * *